US005183424A

United States Patent [19]

Field

[11] Patent Number: 5,183,424

[45] Date of Patent: Feb. 2, 1993

[54] SWIMMING FLIPPER

[76] Inventor: John D. Field, 8 Hodgson St., Crescent Head, New South Wales, Australia, 2440

[21] Appl. No.: 851,277

[22] Filed: Mar. 13, 1992

Related U.S. Application Data

[62] Division of Ser. No. 755,105, Sep. 5, 1991, abandoned.

[51] Int. Cl.[5] ..... A63B 31/12

[52] U.S. Cl. ..... 441/64

[58] Field of Search ..... 441/61, 64; D21/239

[56] References Cited

U.S. PATENT DOCUMENTS

| | | | |
|---|---|---|---|
| 3,810,269 | 5/1974 | Tabata et al. | 441/64 |
| 3,978,537 | 9/1976 | Shamlian | 441/64 |
| 4,738,645 | 4/1988 | Garofalo | 441/64 |

FOREIGN PATENT DOCUMENTS

| | | | |
|---|---|---|---|
| 1238370 | 7/1960 | France | 441/64 |

*Primary Examiner*—Edwin L. Swinehart

*Attorney, Agent, or Firm*—Beehler & Pavitt

[57] ABSTRACT

A swimming flipper has a flipper blade integral with a shoe pocket with a rear entry opening, a heel strap for retaining the swimmers's foot in the foot pocket. An ankle strap attached to the heel strap loops around the ankle of the swimmers's foot above the heel strap and prevents loss of the flipper in the event the heel strap slips from the foot. Both heel and ankle straps have hook and loop fasteners which cooperate to secure the straps around the user's heel and ankle. The heel and ankle straps constitute a unit which can be easily retrofitted as an upgrade for many existing swimming flippers having conventional heel straps.

11 Claims, 2 Drawing Sheets

SWIMMING FLIPPER

This is a division of co-pending application Ser. No. 07/755,105, filed on Sep. 5, 1991, now abandoned.

BACKGROUND OF THE INVENTION

1. Field of the Invention

This invention relates to the field of water sports equipment and, in particular, relates to an improved swimming flipper of the type worn on the feet of swimmers, surfers and divers.

2. State of the Prior Art

Swimming flippers, also called swim fins, have been long used by water sports enthusiasts as a swimming aid to augment the (effective area of the swimmer's foot and increase the propulsive power developed by kicking motions in the water. Swimming flippers of this type typically include a shoe portion or foot pocket which defines a foot receiving cavity, and a wide, generally triangular blade fixed to the foot pocket at its narrow end, the wide end of the blade lying forward of the foot pocket. The foot pocket usually admits only the forward portion of the foot and a heel strap secures the flipper on the foot. Flippers are molded of rubber or other flexible rubber-like synthetic material.

Swimming flippers push large volumes of water and reduce the effort required of the swimmer for rapid forward motion through the water. The efficiency of a particular flipper depends on its design. The wide flipper blade flexes as it is pushed back and forth by the foot against resistance of the water. Such flexing diminishes the propulsive efficiency of the blade and consequently relatively stiff but pliable materials must be used in its manufacture. However, opposite considerations apply to the foot pocket portion of the flipper, which should be relatively soft and pliable for optimum comfort of the foot and to avoid chafing, bruising or blistering of the skin. A compromise, therefore, must be achieved in the selection of materials to satisfy these conflicting objectives. Flipper efficiency is also degraded by lateral water flow over the side edges of the flipper blade, which diminishes the volume of water displaced by the blade as it pushes through the water.

Yet another shortcoming of existing swimming flippers is that they are often lost when the heel strap slips off or the flipper is knocked off the foot, for example when a body surfer tumbles in breaking surf.

A continuing need exists for an improved swimming flipper which can be made at relatively low cost without sacrifice in performance.

BRIEF SUMMARY OF THE INVENTION

The swimming flipper of this invention has a foot receiving shoe portion including an instep and a bottom, a rear entry opening into the shoe portion, and a flipper blade attached to the shoe portion in a plane lying between said instep and said bottom. The improved flipper is characterized by a front toe relief opening in the bottom of shoe portion. The improved flipper is further characterized by at least one relatively large and substantially rigid fin perpendicular to the flipper blade and extending partly on the flipper blade and partly on the instep of the shoe portion for increased rigidity of the blade and providing directional control in conventional usage by a swimmer. The flipper blade preferably has longitudinal flow channeling surfaces in the top surface of the blade for directing water flow longitudinally along the blade and reducing lateral flow across the blade while propelling a swimmer. Yet another feature of the improved flipper is a foot retaining strap assembly attached to the shoe portion, the strap assembly including a heel strap adapted to loop behind the heel of the swimmer's foot and an ankle strap adapted to loop around the ankle of the swimmer's foot above the heel strap for securing the flipper against separation from the foot in the event said heel strap slips from the foot. The heel strap has a static end fixed one to one side of the shoe portion and an opposite free end, a buckle on an opposite side of the shoe portion for securing the opposite free end with a midportion of the heel strap extending across the entry opening, the ankle strap being attached to the midportion of the heel strap. The ankle strap has a one end normally fixed to the midportion and a free end provided with fasteners for releasable attachment to the midportion. The heel strap has loop-and-hook tape elements near its opposite free end for securing its free end returned through the buckle and also for retaining the free end of the ankle strap. Hook-and-loop tape elements at the free end of the ankle strap are engaged between the hook-and-loop tape elements on the heel strap.

DETAILED DESCRIPTION OF THE PREFERRED EMBODIMENTS

Figure 1:
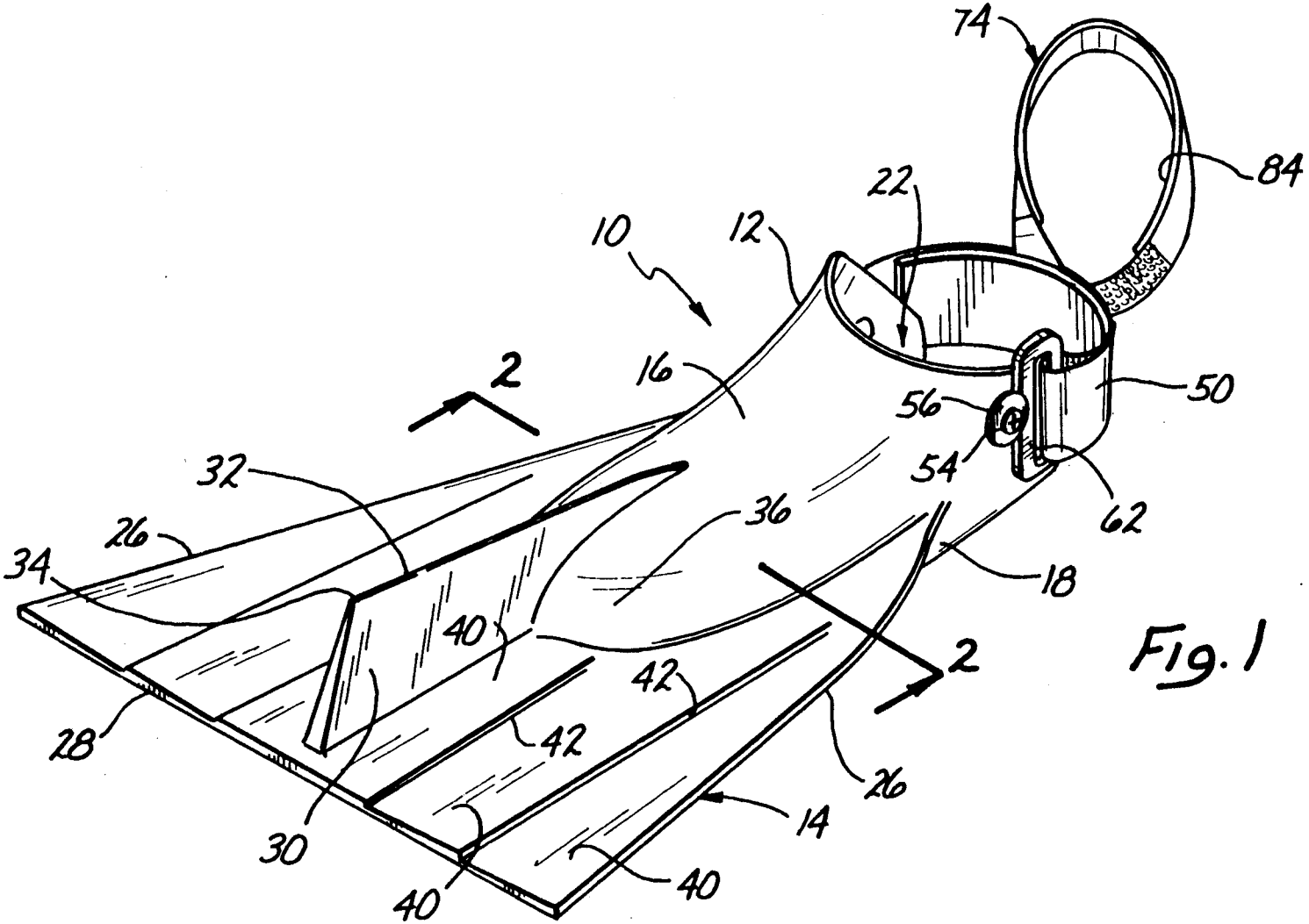
FIG. 1 is a perspective view of the swimming flipper of this invention.
Figure 2:
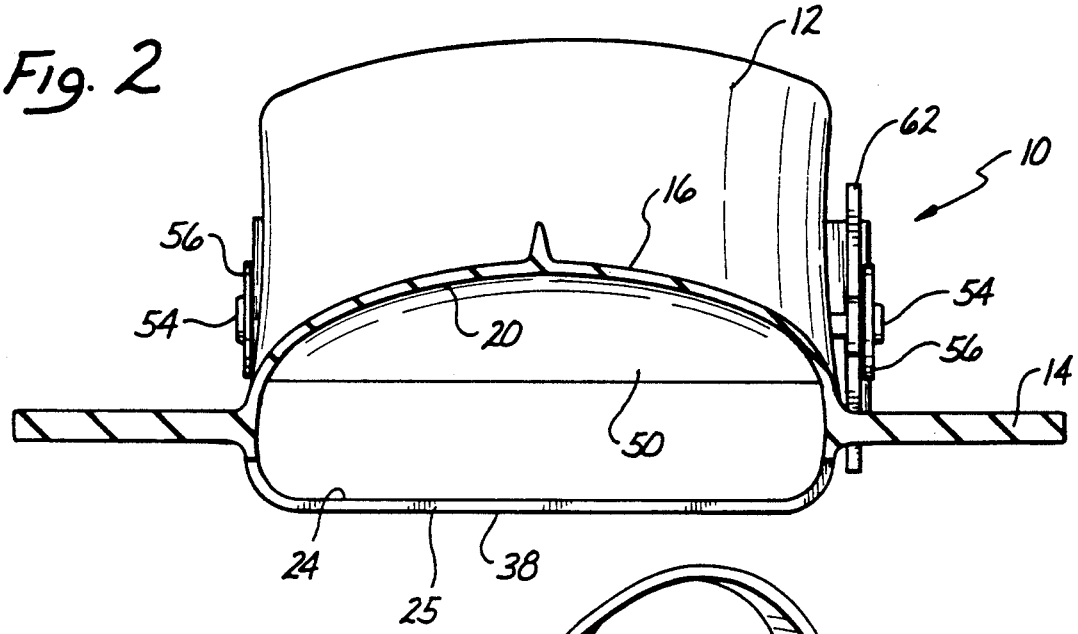
FIG. 2 is a cross-section of the swimming flipper taken along line 2—2 in FIG. 1.

With reference to the drawings, in FIG. 1 the swimming flipper 10 of this invention has a generally foot shaped shoe portion generally designated by numeral 12, to which is attached a flipper blade 14. The shoe portion 12 includes a sloping instep 16 and a bottom 18 including a sole 38 which together define an interior foot receiving pocket 20, best seen in the cross-sectional view of FIG. 2. The shoe portion has a rear entry opening 22 and a forward toe relief opening 24 defined at the toe cap 36 of the shoe portion under the flipper blade 14, as shown in FIG. 2. The sole 38 terminates in a forward edge 25 rearwardly of the toe cap 36. The toe relief opening 24 extends the full width of the foot pocket, so that all toes of the foot extend beyond the forward edge of the bottom 18. The toe aperture 24 allows flexing of the toes without bruising or chafing and prevents cramping of the toes caused by constricting swimming fins of the prior art.

The flipper blade 14 has divergent side edges 26 and a wide forward free end 28. The flipper blade 14 lies in a plane which is horizontal to the user's foot between the instep and the bottom of the shoe portion. A stiff directional fin 30 rises perpendicular to the flipper blade 14 and extends continuously over the rounded toe cap 36 and onto the instep 16. The fin 30 is molded integrally with the flipper 14 and shoe portion 12 and is of substantial thickness and rigidity. The fin 30 is of substantial height and has a top edge 32 above the instep 16. The swimming flipper 10 is symmetrical along a longitudinal center line, so that it is interchangeable between the left and right foot, and the guide fin 30 lies on the center line. The fin 30 extends nearly the full length of the flipper blade 14 forward of the foot portion 12 and continues about three inches over the toe cap area 36 and instep 16 in a longitudinal direction. The forward tip 34 of the guide fin may be about 2.5 inches above the top surface of the flipper blade 14, dropping slightly in height towards the instep 16. The thickness of the vertical fin 30 tapers from a thicker base to a thinner top edge 32. The top profile of the fin remains substantially uniform in thickness along the entire length of the vertical fin regardless of the actual height of the fin at any particular point along its length. The fin 30 is molded to merge smoothly at its intersection with the blade 14 and the top of the shoe portion 12, to minimize flow turbulence and friction. The vertical guide fin 30 considerably enhances the rigidity of the flipper blade 14 along its longitudinal axis for reduced flexing when the blade is pushed against water. This translates into increased propulsive power for the swimmer in that a somewhat greater volume of water is displaced by the kicking motion of the flipper blade 14, as compared to a more yielding, flexible blade. The increase in flipper blade rigidity is achieved without a corresponding increase in stiffness of the shoe portion, which can be made more flexible and comfortable than would be the case without the structural contribution of the vertical guide fin 30. The length of the flipper blade 14 is relatively short, extending, for example, about 5½ inches in front of the toe cap 36 of the foot portion 12, giving the swimmer greater ease of movement while reducing the likelihood of cramping of the foot or leg.

The underside or bottom surface of the blade 14, as well as the undersurface of the bottom 18 of the shoe portion 12, are both smooth. The flat sole 38 of the shoe portion lies in a common plane with the underside of the blade 14, to present a smooth continuous surface to the flow of water over the bottom of the swimming flipper 10. The toe relief aperture lies below the toe cap area 36 between the sole 38 and the blade 14.

The top surface of the flipper blade 14 has longitudinal channels defined between stepped surfaces 40 and vertical edge surfaces 42. The stepped surfaces 40 are angled slightly upwardly and away from the center of the fin in the direction of the side edges 26. The surfaces 40 on opposite sides of the fin 30 face slightly towards and together with the edges 42 tend to contain water flow along the blade towards the free end 28, reducing undesirable lateral flow of water over the side edges 26. Such lateral loss of displaced water reduces the propulsive efficiency of swimming flippers. The channeling effect of the longitudinal surfaces 40, 42 combine with the guide fin 30 to provide true directional stability, enhancing control and maneuverability of the swimming flipper 10 in ocean waves and turbulent waters. This is a consideration of particular importance to body surfers who need to maintain a stable body position while moving rapidly with a breaking wave.

Yet another benefit of the vertical fin 30 and the channeling surfaces 40, 42 is their significant reduction in the common tendency of swimming flippers to move towards each other as the swimmer kicks in the water. This tendency causes the flippers to interfere with free foot swimming motions as their inside edges catch against each other with the up and down kicking motions of the swimmer.

The flipper blade configuration of this invention is intended to optimize the propulsive power of the swimmer's kicking motion and provide improved directional control and stability, particularly in critical sections of ocean waves for use in body surfing, while promoting comfort and security of the user's foot. The flipper 10 can be molded from elastomeric or rubber compounds with the finished product having a stiff blade 14 and a shoe portion 12 more supple than the flipper blade. The bilateral symmetry of the swimming flipper 10 along a longitudinal center line reduces manufacturing and distribution costs in that a single manufacturing mold is needed to make a pair of flippers. The improvements of this invention are, however, not limited to symmetrical fins, and can be used in nonsymmetrical flipper configurations.

Figure 3:
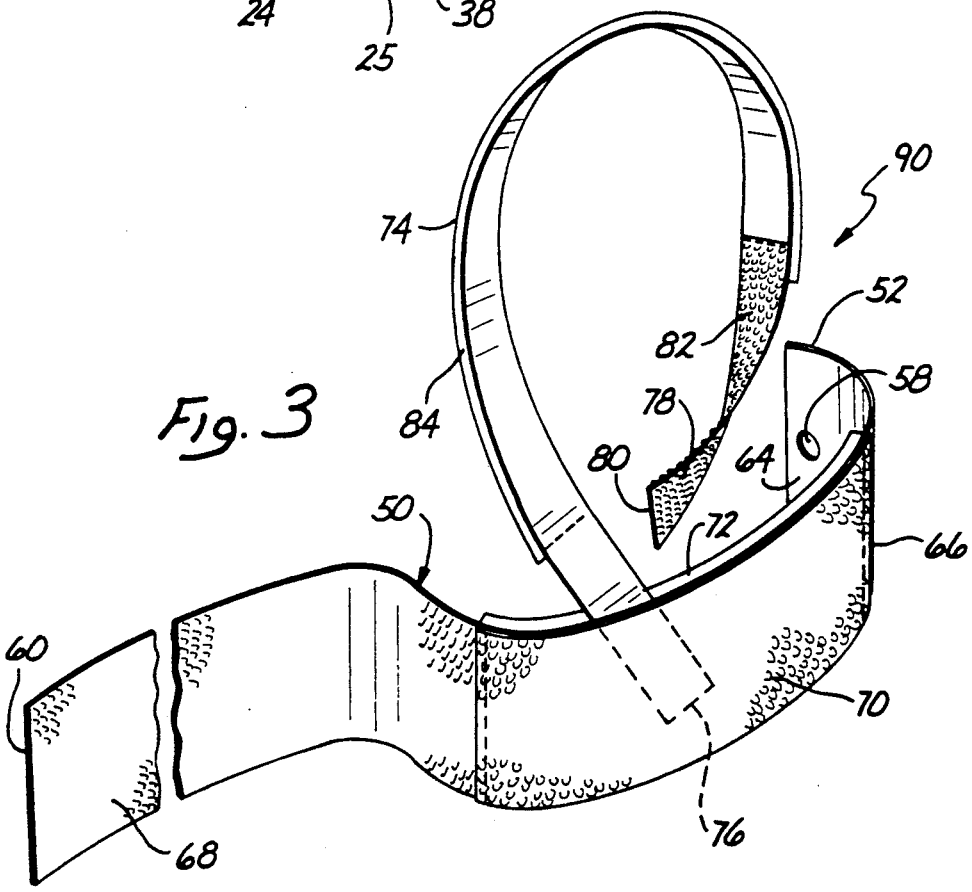
FIG. 3 is a perspective view of the heel and ankle strap assembly of the improved flipper, showing the hook and loop fastening tape elements on both straps.

The flipper 10 is retained to the foot of the user by a heel strap 50 which has a static end 52 normally fixed to one side of the shoe portion 12 by a stainless steel bolt 54 threaded into a brass tee nut inserted in a hole in the side of the shoe portion. The bolt 54 passes through a washer 56 and hole 58 in the heel strap, as shown in FIGS. 2 and 3. The opposite free end 60 of the heel strap is held by a thread through D-ring buckle 62 which can swivel about its mounting bolt 54, as best shown in FIG. 1, attached to the opposite side of the shoe portion 12 by another bolt 54 and washer 56 mounted to a second brass tee nut in another hole in the shoe portion 12. End 60 of the heel strap passes through a slot in the D-ring buckle 62 and is folded back and returned over the midportion of the heel strap which now spans the opposite sides of the foot portion 12 across the rear entry opening 22, as indicated in FIG. 2. The heel strap has an inside surface 64 which faces the entry opening 22 of the shoe portion, and an opposite outer side 66. The free end 60 of the heel strap is secured by a hook tape element 68 fixed to the outside surface 66 of the heel strap adjacent to the free end 60, and a loop tape fastener element 70 also attached to the same outside surface 66 along a mid-portion of the heel strap further spaced from the end 60. The free end 60 is threaded through the buckle 62 and folded back so that the loop tape 68 engages with the loop tape element 70 to hold the free end in place against the midportion of the heel strap. This fixes the length of the midportion between the two sides of the shoe portion 12. The effective length of the heel strap can be readily adjusted by returning a greater or lesser length of the heel strap at the buckle 62. Neoprene padding 72 is attached to the inside surface 64 along the midportion of the heel strap for comfort and protection of the heel area of the foot.

A thinner ankle security strap 74 ensures retention of the swim flipper 10 to the leg in the event that the flipper 10 comes off the foot, as may occur in turbulent wave action while body surfing. The ankle strap 74 has a static end 76 which is sewn to a midpoint of the heel strap 50, preferably between the heel strap and the neoprene padding 72, as shown in FIG. 3. A hook tape element 78 is fixed to an inside surface near a free end 80 of the ankle strap, while a loop tape element 82 is fixed to the opposite surface of the ankle strap also near the free end 80. The hook and loop tape elements 80, 82 permit the free end 80 of the ankle strap to be securely retained and anchored to a midpoint of the heel strap 50, between the interlocked hook and loop tape elements 68, 70 of the heel strap. The inside surface of the ankle strap 74 also has a layer 84 of neoprene padding where the strap makes contact with the foot and ankle to prevent chafing and blistering caused by rubbing of the strap against the skin.

The flipper 10 is worn by inserting a foot through the entry opening 22 into the shoe portion 12. The free end 68 of the heel strap is then passed behind the ankle and through the D-ring buckle 62. The ankle strap 74 is then looped around the front of the ankle above the instep and the free end 80 returned towards the heel area, where the hook tape element 78 of the ankle strap is mated to the loop tape element 70 of the heel strap. The free end 60 of the heel strap is then secured by mating the hook tape element 68 of the heel strap to both the loop element 82 of the ankle strap and the loop element 70 of the heel strap. The interlocking tape elements 68, 70, 78, 82 firmly secure both straps 50, 74 around the foot of the user.

The strap arrangement of the invention can be retrofitted to prior art swimming flippers by simply attaching the static end 52 of the heel strap to an existing fastener on the flipper or, if necessary, providing a replacement fastener equivalent to the bolt and tee nut arrangement described above, with a D-ring 62 on the opposite side of the flipper for holding the free end of the strap. Since the ankle safety strap 74 is carried on the heel strap 50 as a strap assembly or unit 90 shown in FIG. 3, retrofitting to a prior art flipper fin is uncomplicated.

This invention contemplates that more than one directional fin 30, for example two parallel blades, may be provided joining the blade 14 to the top of the shoe portion 12. The actual length, height and shape of the fin 30 may vary substantially without thereby detracting from the objective of providing directional control and enhanced flipper blade rigidity. It is contemplated that in all cases the guide fin or fins are relatively large and rise to a significant height along the curved front end to toe cap 36 of the shoe portion 12.

While a preferred embodiment of the invention has been described and illustrated for purposes of clarity and example, it must be understood that many changes, modifications and substitutions will become obvious to those possessed of ordinary skill in the art without thereby departing from the scope and spirit of the present invention, which is defined by the following claims.

What is claimed is:

1. A swimming flipper comprising:

a foot receiving shoe portion defining a foot pocket, a rear entry opening into said foot pocket, and a flipper blade attached to said shoe portion, foot retaining strap means attached to said shoe portion for retaining a swimmer's foot against withdrawal from said entry opening when the flipper is worn on a swimmer's foot, said strap means comprising a heel strap adapted to loop behind the heel of the swimmer's foot and an ankle strap adapted to loop around the ankle of the swimmer's foot above said heel strap for securing the flipper against separation from the foot in the event said heel strap slips from the foot, said ankle strap having an end attached to said heel strap, and an opposite free end provided with fastener means for releasable attachment to said heel strap.

2. The flipper of claim 1 wherein said heel strap has one end normally attached to one side of said shoe portion and an opposite free end, buckle means on an opposite side of said shoe portion for securing said opposite free end with a midportion of said heel strap extending across said entry opening, said ankle strap being attached to said midportion of said heel strap.

3. The flipper of claim 2 wherein said ankle strap has one end normally fixed to said midportion and said fastener means at said free end being releasably attachable to said midportion.

4. The flipper of claim 3 wherein heel strap has loop-and-hook tape elements near said opposite free end for attaching to said midportion, an end portion of the heel strap returned through said buckle means, such that the length of said midportion around the heel of a foot can be adjusted according to the length of said end portion.

5. The flipper of claim 4 wherein said fastener means comprise loop-and-hook tape elements at said free end of said ankle strap for engagement to said midportion of said heel strap.

6. The flipper of claim 5 wherein said loop-and-hook tape elements of said heel strap also engage and retain said loop-and-hook tape elements at said free end of said ankle strap to said midportion.

7. The flipper of claim 5 wherein said tape elements include a loop tape element on one side of said ankle strap and a hook tape element on the opposite side of the ankle strap.

8. A swimming flipper comprising:

a foot receiving shoe portion including an instep and a bottom, a rear entry opening into said shoe portion, and a flipper blade attached to said shoe portion in a plane lying between said instep and said bottom, foot retaining strap means attached to said shoe portion for retaining a swimmer's foot against withdrawal from said entry opening when the flipper is worn on a swimmer's foot, said strap means comprising a heel strap adapted to loop behind the heel of the swimmer's foot and an ankle strap adapted to loop around the ankle of the swimmer's foot above said heel strap for securing the flipper against separation from the foot in the event said heel strap slips from the foot, said ankle strap being attached only to said heel strap.

9. The flipper of claim 8 wherein said heel strap has one end normally attached to one side of said shoe portion and an opposite free end, buckle means on an opposite side of said shoe portion for securing said opposite free end with a midportion of said heel strap extending across said entry opening, said ankle strap being attached between said one end and said opposite free end said heel strap.

10. The flipper of claim 9 wherein said heel strap has first fastener means for securing to said midportion an end portion of the heel strap returned through said buckle means, and said ankle strap has one end normally fixed to said midportion and a free end provided with second fastener means engageable by said first fastener means for releasable attachment to said midportion.

11. The flipper of claim 10 wherein said first and second fastener means comprise loop-and-hook tape elements.

* * * * *